United States Patent [19]

Hegyi et al.

[11] Patent Number: 4,464,004

[45] Date of Patent: Aug. 7, 1984

[54] SEPARABLE ELECTRIC CONNECTOR MODULE WITH GAS-ACTUATED PISTON

[75] Inventors: Steven M. Hegyi, Hickory, N.C.; Joseph A. St. Jacques, Shreveport, La.

[73] Assignee: General Electric Company, King of Prussia, Pa.

[21] Appl. No.: 366,496

[22] Filed: Apr. 8, 1982

[51] Int. Cl.[3] ..... H01R 13/52

[52] U.S. Cl. ..... 339/111; 339/143 T

[58] Field of Search ..... 339/111, 143 T, 278 C

[56] References Cited

U.S. PATENT DOCUMENTS

| | | | |
|---|---|---|---|
| 2,981,916 | 4/1961 | O'Brien | 339/278 C X |
| 3,539,972 | 11/1970 | Ruete et al. | 339/111 |
| 4,119,358 | 10/1978 | Tachick et al. | 339/111 |

*Primary Examiner*—Z. R. Bilinsky

*Attorney, Agent, or Firm*—William Freedman

[57] ABSTRACT

A separable connector module of the fault-actuated piston type comprises an aluminum container tube, a bore contact member within the container tube, and a piston for actuating the bore contact member in response to closing on a fault. The piston is primarily of copper but has a thin coating of dissimilar metal on its exterior. A sleeve of copper tightly fitting with the container tube acts as a cylinder for receiving the exterior of the piston in contacting relationship between copper and said dissimilar metal. The sleeve has adjacent one end an integrally formed end wall containing a central opening, and a copper-alloy nut is brazed to the end wall adjacent the central opening.

4 Claims, 4 Drawing Figures

SEPARABLE ELECTRIC CONNECTOR MODULE WITH GAS-ACTUATED PISTON

CROSS-REFERENCE TO RELATED PATENT

The subject matter of this application is related to that of U.S. Pat. No. 4,175,817—Tachick et al., assigned to the assignee of the present invention, which patent is incorporated by reference in the present application.

BACKGROUND

This invention relates to a separable electrical connector module and, more particularly, to a module of this type that includes a bore contact and coupled thereto a piston upon which gas generated during a fault-closing operation acts to drive the bore contact toward a mating rod contact, thereby to facilitate fault-closing.

In typical prior art designs of such modules, the piston has been made of copper, and it is adapted to slide within a container tube that is made of aluminum. A body of electrical insulation is molded or cast about the container tube; and the aluminum of the container tube provides high strength, enabling the container tube to withstand the high pressures usually associated with such molding or casting. The use of aluminum for the container tube also provides excellent compatibility with the insulating material, particularly when the insulating material is an epoxy compound such as used for integrated bushings. Examples of processes that have been used for incorporating the insulation are injection molding, compression molding, pressure gelation molding, and liquid casting.

Another feature of the above-described typical prior art design is that the aluminum container tube usually contains a thickened end wall that has a threaded opening therein for receiving an externally-threaded copper conductor. Electric current entering the module through the copper conductor follows a path that extends through the mating threads of the conductor and the container tube, into the aluminum container tube, and then into the copper piston to the bore contact.

Because of oxide formation and the relatively high resistance of a bare aluminum-to-copper connection, it has been customary to tin-plate the aluminum container tube where it is to contact the threaded conductor and the piston. However, there have been a number of problems associated with this tin-plating. Tin-plating aluminum, especially a long tube with an end wall containing a threaded opening (such as the container tube), has proven to be difficult and expensive. It has been especially difficult to provide a good tin-plate coating on the threads of the opening. An excessive amount of plating on these threads interferes with proper mechanical mating of the conductor module and the threaded conductor, while the absence of adequate plating has led to electrical problems under high current or load-cycling conditions.

The sliding connection between the piston and container tube has also had problems. When both the copper piston and the surrounding cylinder portion of the aluminum container tube are tin-plated, the sliding contact between piston and cylinder is one of tin on tin, which leads to high drag forces and material galling, both of which can result in undesirably slow piston-response during fault-closing operations.

SUMMARY

An object of our invention is to provide a separable connector module of the fault-actuated piston type in which the above-described tin-plated joints between copper and aluminum are eliminated, but the above-described advantageous features of the aluminum container tube are retained.

Another object is to provide a design of the type set forth in the immediately-preceding paragraph which can be easily and inexpensively fabricated.

In carrying out our invention in one form, we provide a separable connector module adapted to conduct current between a mating connector module and an externally-threaded bushing well stud. The first-mentioned module comprises an insulating housing having an elongated receiving passageway and a rigid container tube of aluminum closely fitted within said passageway. The container tube has one inner end located adjacent the bushing well stud. Intermediate the ends of the container tube are a bore contact member and a piston fixed thereto and adapted to drive the bore contact member along the axis of the container tube in response to gas being generated within the container tube. The piston is primarily of copper but has a thin coating of dissimilar metal on its exterior. A sleeve of copper tightly fitting within the container tube acts as a cylinder for slidably receiving the exterior of the piston in contacting relationship between copper and said dissimilar metal. The sleeve has adjacent the inner end of the container tube an integrally-formed end wall containing a central opening. Brazed to the end wall adjacent the central opening is a copper-alloy nut having internal threads adapted to mesh with threads on the bushing well stud.

BRIEF DESCRIPTION OF DRAWINGS

For a better understanding of the invention, reference may be had to the following specification taken together with the accompanying drawings, wherein.

DETAILED DESCRIPTION OF PREFERRED EMBODIMENT

Figure 1:
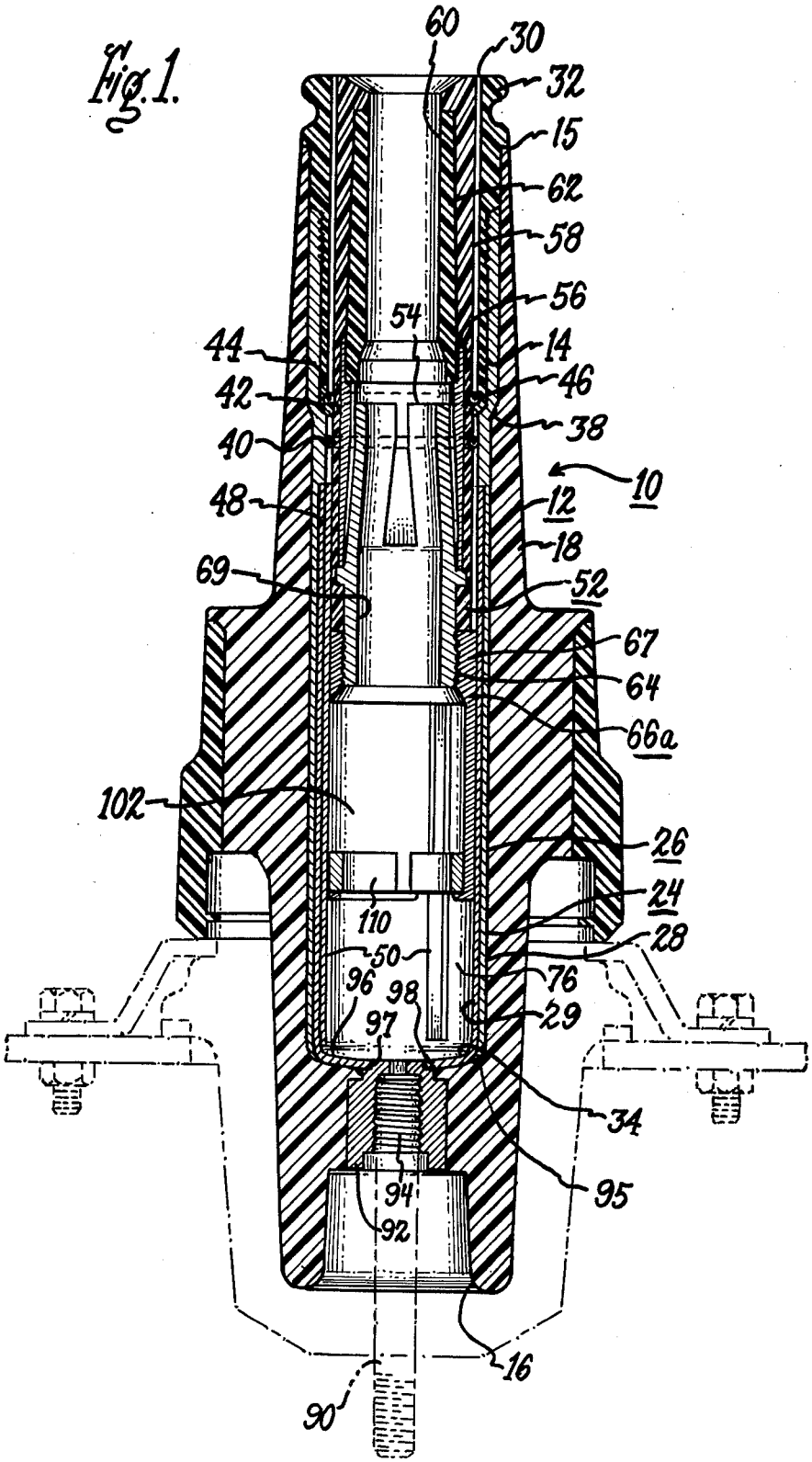
FIG. 1 is a sectional view through a separable connector module embodying one form of the invention.
Figure 2:
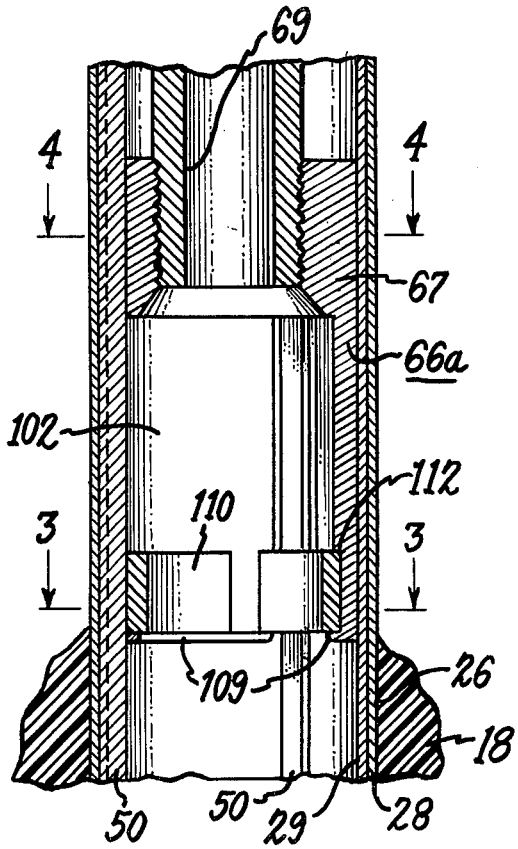
FIG. 2 is an enlarged view of a portion of FIG. 1.

The separable connector shown in FIG. 1 is in many respects similar to that shown and claimed in the aforesaid Tachick et al. patent. Accordingly, the same reference numerals are used for the parts of FIG. 1 as are used for corresponding parts in the Tachick et al. patent; and reference may be had to the Tachick et al. patent for a detailed description of such parts. Generally speaking, where the parts have been fully described in the Tachick et al. patent, they will not be described in the present application except insofar as deemed necessary to provide an understanding of the present invention. Emphasis in the present description will be placed on those features that are not shown in the Tachick et al. patent.

In the separable connector module 10 of FIG. 1, there is a container tube 28 that is positioned within an elongated receiving passageway 14 in the insulating housing 12. In a preferred form of the invention, the bulk of the housing 12 is of organic insulation which is injection molded about the container tube. The container tube is of aluminum, and this aluminum imparts high strength to the container tube to enable it to effectively withstand the high pressures associated with such injection molding. The use of aluminum for the container tube also provides excellent compatibility with the surrounding insulating material, particularly when the insulating material is an epoxy compound such as used for integrated bushings. This compatibility eliminates the need for conformal coatings to provide matching coefficients of thermal expansion between the container tube material and the epoxy of the bushing. It is to be understood that the insulation can be incorporated by other suitable molding or casting processes, such as compression molding or pressure gelation molding.

Tightly fitting within the container tube 28 is a sleeve 29 of copper. This sleeve 29 extends from the lower end of the container tube to a location just below a retaining ring 40 in the top half of the module. The sleeve 29 has a cylindrical interior wall, or bore, 48 that has one or more keyribs formed in it. In the illustrated embodiment there are three keyribs, but in a commercial form of this invention only a single keyrib is used. Each keyrib has a substantially rectangular cross-section and runs longitudinally of the sleeve 29 from near its lower end 34 to its upper end. The illustrated keyribs are equally spaced about the axis of the container tube.

Figure 4:
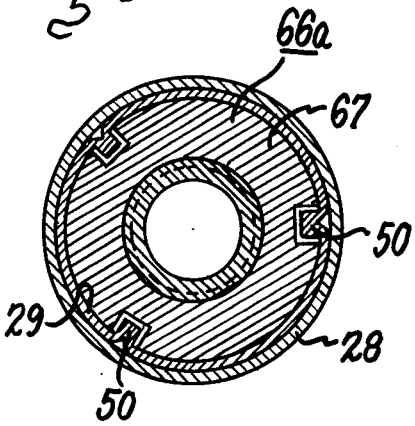
FIG. 4 is a sectional view along the line 4—4 of FIG. 2.

The piston upon which gas pressure acts during a fault-closing operation is shown at **66*a*. This piston 66*a* is slidably received within the copper sleeve 29 in the container tube 28. At its upper end the piston 66*a* includes a cylindrical body portion 67 that contains in its outer periphery three angularly-spaced keyways that respectively receive the three angularly-spaced keyribs 50 on the bore of the surrounding copper sleeve 29, as is best shown in FIG. 4**.

Figure 3:
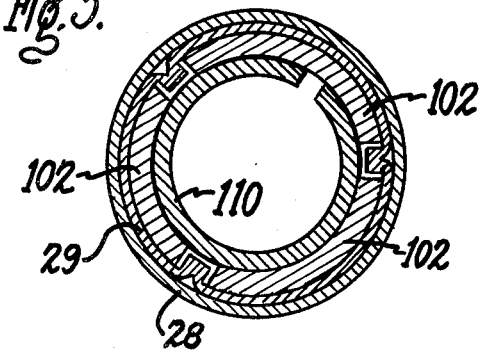
FIG. 3 is a sectional view along the line 3—3 of FIG. 2.

The piston **66*a* has a downwardly-extending generally tubular portion that comprises three angularly spaced segments 102. As best shown in FIG. 3, these segments 102 are biased radially-outward into high pressure engagement with the bore of the copper sleeve 29, contacting this bore in angularly-spaced locations between the keyribs 50. The segments 102 are preferably integral with the body portion 67 of the piston 66*a*, and both the body portion and the segments are made of copper. The entire exterior of the copper piston is preferably plated with tin or some other suitable dissimilar metal such as nickel so as to minimize the formation on this exterior of copper oxides that could interfere with making a good electrical connection between the segments 102 and the surrounding sleeve 29**.

The segments 102 are biased radially outward into high pressure engagement with the surrounding sleeve 29 by means of a split annular spring ring 110. This spring ring 110 is located within the tube defined by segments 102 and has resilience that tends to expand the ring in diameter. This resilience acts upon the surrounding segments 102 to force them radially outward into high pressure engagement with the surrounding copper sleeve 29. A more detailed description of the annular split ring is contained in application Ser. No. 224,404—Goldbach, now U.S. Pat. No. 4,350,406 filed Jan. 12, 1981, and assigned to the assignee of the present invention, which application is incorporated by reference in the present application.

Current flows through the module 10 via a path that extends upwardly from the bottom of the module through the copper sleeve 29 in the container tube 28 and then into segments 102 of the piston **66*a* via the contacting regions between segments 102 and sleeve 29 in the vicinity of spring ring 110. The high pressure engagement between the segments 102 and the copper sleeve 29** in this region provides a good electrical connection between these parts. Although sufficient to provide for a good electrical connection, the engaging pressure is not sufficiently high to interfere with the desired upward movement of the piston under fault-close conditions, as is referred to hereinafter.

Although the piston **66*a* of this module has been modified from that of the Tachick et al. patent, the general operation of the module is basically the same as that of the Tachick et al. patent. That is, an arc developed in the bore 60 of the snuffer liner 62 of ablative material during a fault-close operation generates gases which pass downwardly through the central port 69 in the bore contact 54 and quickly build up a pressure beneath piston 66*a*. This pressure acts to drive the piston upwardly along with the bore contact 54 coupled thereto, thereby facilitating closing under fault conditions. A spring-loaded check valve (such as 75 in the Tachick et al. patent) can be used in the port 69, but has been omitted in FIG. 1** to simplify the drawing.

It is highly desirable that the piston move upwardly along the cylinder under fault-closing conditions with as little delay as possible. The arcing time, which it is desired to minimize, is directly proportional to this delay. In prior modules having tin-to-tin contact between piston and cylinder, a typical arcing time was 2.7 msecs under high fault current conditions; whereas with our module having the above-described copper-to-tin contact, we have consistently achieved arcing times in the neighborhood of 2.2 msecs under corresponding fault current conditions. The drag force in our module has typically measured about 20 pounds as compared to the 50 to 100 pounds typically present in the above-described prior module.

Electric current is carried to and from the lower end of the connector module by means of a stationary bushing well stud 90, shown in FIG. 1 in dot-dash lines. This bushing well stud 90 is of copper and has an externally-threaded upper end. The connector module 10 includes a nut 92 at its lower end having internal threads 94 that are adapted to mesh with the external threads of the bushing well stud 90 so that electric current can flow across the threaded connection between the nut 92 and the stud 90. The copper sleeve 29 has an integral end wall 96 that contains a central opening 97. The upper end of the nut 92 is fitted within this central opening 97, and the nut is brazed to the end wall 96 at 98.

The nut 92 is of a copper alloy which has good machinability and a relatively high strength so that the internal threads 94 machined into it are of high strength, which enables us to avoid stripping or other damage to the threads during installation of the module, when the module is tightly threaded onto the bushing well stud 90. The high strength of the threads also enables the module to be repeatedly removed and reinstalled on other bushing well studs without damage to the threads.

A suitable material for the nut 92 is a brass containing, by weight, 60–63% copper, 2.5–3% lead, remainder zinc except for incidental impurities. Another suitable material is a heat-treatable leaded copper-nickel alloy containing, by weight, about 97.3% copper, 0.8–1.2% nickel, 0.8–1.2% lead, and miscellaneous incidental impurities.

As pointed out in the introductory portion of this specification, it has been customary to make the container tube and its lower end wall with threaded opening of a single aluminum part, as in the aforesaid Tachick patent. This has necessitated plating this part with tin or the like, with special care being taken where current enters and leaves the container tube, i.e., at the threads and along the bore portion that receives piston 66*a*. We are able to completely dispense with such plating because of the presence of copper sleeve 29 and the copper-alloy nut brazed to the internally-formed lower end portion 34 of sleeve 29. The presence of the copper-alloy nut makes it possible to make a good electrical connection with the externally threaded copper stud 90 without the need for tin plate between the threads on the nut and those on the stud. The presence of the copper sleeve 29 as a liner in the aluminum container tube 28 provides a tubular copper surface along which the tin-plated copper piston is able to slide, thus providing copper-to-tin contact between these parts, which obviated the need for tin plating on the surrounding cylinder in the region where there is sliding engagement.

The copper sleeve 29 can be made from ordinary copper water pipe, with its integral end wall 96 being formed by a spinning and/or die forming operation. This copper water pipe is not readily machinable, but we obviate the need for machining this pipe because we utilize for the sleeve 29 a simple configuration that can be developed without machining. The keyribs 50 in the sleeve 29 are formed with a die that deforms the cylindrical portion of the sleeve to form the keyribs. This deforming operation can be made simpler if only a single keyrib is used, which is the design that we use in a commercial embodiment.

The copper sleeve 29 is incorporated into the aluminum container tube 28 by pressing the sleeve into a counterbored portion of the container tube and then spinning the free end of the container tube (which is at its lower end in FIG. 1) around the back side of wall 96 of the copper sleeve. This spinning operation forms on the free end of the container tube 28 a radially-inwardly projecting annular lip 95 that presses tightly against the back of wall 34, thus retaining the sleeve 29 in place within the counterbore of the container tube.

The aluminum of the container tube 28 is readily machinable, and thus tube 28 can easily be machined to provide any needed grooves, counterbores, or the like.

In referring herein to "aluminum", we intend to comprehend within this term not only substantially pure aluminum but also aluminum-base alloys. Likewise the term "copper" is intended to comprehend copper-base alloys as well as substantially pure copper.

While we have shown and described particular embodiments of our invention, it will be obvious to those skilled in the art that various changes and modifications may be made without departing from our invention in its broader aspects; and we, therefore, intend herein to cover all such changes and modifications as fall within the true spirit and scope of our invention.

What we claim is:

1. A separable electrical connector module adapted to conduct current between a mating connector module and an externally-threaded bushing well stud, comprising:

(a) an insulating housing having an elongated receiving passageway therein;

(b) a rigid container tube of aluminum closely fitted within said receiving passageway and having an outer end for receiving a rod contact member of the mating connector module and an inner end located adjacent said bushing well stud;

(c) a snuffer tube in said container tube having a central bore for receiving said rod contact member and having ablative material inside said bore;

(d) a bore contact member normally located intermediate the ends of said container tube;

(e) a piston fixed to said bore contact member and adapted to drive said bore contact member along the axis of said container tube toward said outer end of the container tube in response to gas generated by arcing in said snuffer-tube bore, said piston being primarily of copper but having a thin coating of dissimilar metal on its exterior;

(f) a sleeve of copper tightly fitting within said container tube, said sleeve acting as a cylinder for slidably receiving the exterior of said piston in contacting relationship between copper and said dissimilar metal, said sleeve having adjacent the inner end of said container tube an integrally-formed end wall containing a central opening; and (g) a copper-alloy nut brazed to said end wall adjacent said central opening, said nut having internal threads adapted to mesh with threads on said externally-threaded bushing well stud.

2. The connector module of claim 1 in which said nut has a portion seated within said central opening and a bore containing said internal threads that generally aligns with said central opening.

3. The connector module of claim 1 in which said thin coating on said piston is a plated-on coating primarily of tin.

4. The connector module of claim 1 in which said container tube has an annular lip at its inner end projecting radially inward and fitting against the back side of said end wall to retain said sleeve in place within said container tube.

* * * * *